US009433241B2

(12) United States Patent
Jalloul et al.

(10) Patent No.: US 9,433,241 B2
(45) Date of Patent: Sep. 6, 2016

(54) PREPACKAGED SMOKABLE MATERIAL CAPSULE

(75) Inventors: Samer Jalloul, Beirut (GB); Georges El Hajj, Dubai (AE); Nabil Jaber, Dubai (AE)

(73) Assignee: SHISHAPRESSO S.A.L., Park District, Beirut (LB)

( * ) Notice: Subject to any disclaimer, the term of this patent is extended or adjusted under 35 U.S.C. 154(b) by 487 days.

(21) Appl. No.: 14/001,678

(22) PCT Filed: Jan. 13, 2012

(86) PCT No.: PCT/GB2012/050067

§ 371 (c)(1),
(2), (4) Date: Jul. 9, 2014

(87) PCT Pub. No.: WO2013/001272

PCT Pub. Date: Jan. 3, 2013

(65) Prior Publication Data

US 2014/0326257 A1 Nov. 6, 2014

Related U.S. Application Data

(60) Provisional application No. 61/503,187, filed on Jun. 30, 2011.

(51) Int. Cl.

| | |
|---|---|
| ***A24F 5/04*** | (2006.01) |
| ***A24D 1/14*** | (2006.01) |
| ***A24F 1/30*** | (2006.01) |

(52) U.S. Cl.

CPC . *A24F 5/04* (2013.01); *A24D 1/14* (2013.01); *A24F 1/30* (2013.01)

(58) Field of Classification Search

None

See application file for complete search history.

(56) References Cited

U.S. PATENT DOCUMENTS

| | | | |
|---|---|---|---|
| 3,545,449 | A | 12/1970 | Pecor |
| 3,792,704 | A | 2/1974 | Parker |
| 4,944,317 | A | 7/1990 | Thal |
| 2007/0215164 | A1 | 9/2007 | Mehio |
| 2008/0060663 | A1 | 3/2008 | Hamade et al. |
| 2010/0126518 | A1 | 5/2010 | Saleh |
| 2010/0252057 | A1 | 10/2010 | Saleh |
| 2011/0186060 | A1 | 8/2011 | Saleh |

FOREIGN PATENT DOCUMENTS

NL WO 2010115611 A1 * 10/2010 ..... A24D 1/14

* cited by examiner

*Primary Examiner* — Michael J Felton

(74) *Attorney, Agent, or Firm* — Global Intellectual Property Agency, LLC; Daniel Boudwin

(57) ABSTRACT

Disclosed is a prepackaged smokable material capsule, comprising a container having an internal volume that allows a user to place a packaged amount of shisha or similar tobacco product into a hookah bowl without physical contact therewith. The capsule has a removable seal, an inlet, outlet and an internal agitator means within the capsule. The seal removably covers its upper inlet and lower outlet prior to use. Once removed, the inlet and outlet are preferably pre-perforated, or alternatively may then be perforated by a user, prior to a layer of coals be placed thereonto for burning the capsule contents and allowing smoke to be drawn therefrom. The imbedded agitator provides a means to control the density of the capsule contents and prevent clumping to ensure free flowing passage of air therethrough. Also disclosed is a capsule retainment system comprising a hookah bowl and capsule clamp.

13 Claims, 7 Drawing Sheets

PREPACKAGED SMOKABLE MATERIAL CAPSULE

CROSS REFERENCE TO RELATED APPLICATION

This application claims the benefit of International Application No. PCT/GB2012/050067, filed Jan. 13, 2012, now pending, which claims the benefit of U.S. Provisional Application No. 61/503,187, filed on Jun. 30, 2011, entitled "Hookah Molasses Capsule." Each patent application identified above is incorporated here by reference in its entirety to provide continuity of disclosure.

BACKGROUND OF THE INVENTION

1. Field of the Invention

The present invention relates to tobacco smoking devices, pipes and packages of tobacco for utilization in a pipe or hookah. More specifically, the present invention relates to a prepackaged volume of a smokable product such as shisha or hookah tobacco, wherein the elements of the package provide improved freshness, better handling of the product prior to being smoked and a means to control the density of product within the capsule prior to its use. The present invention further relates to a means of loosening the contents prior to its use and while burning, wherein the contents can be separated and disturbed for improved airflow and even burning therethroughout. The following disclosure includes the elements of the prepackaged capsule, along with a means to retain the capsule on a hookah bowl while smoking its contents. For simplicity and uniformity, the following disclosure will be discussed as providing a prepackaged capsule of shisha, or flavored tobacco for use in a hookah bowl apparatus. It is desired, however, to disclose a smokable material capsule for use in any smoking apparatus, wherein the material within the capsule may take the form of any smokable product and the capsule may employ several embodiments with regard to its shape and form.

Hookah smoking is a popular method of smoking tobacco, wherein smoke is drawn through a water pipe apparatus. Shisha, which is generally a molasses flavored tobacco, is placed on an inlet of the hookah pipe and in contact with burning coals to ignite the shisha, initiating burn the production of smoke for user intake. The shisha is packed into a bowl positioned at the hookah inlet and allowed to slowly burn as air is drawn therethrough, directing smoke towards an inhaling user. The smoke from the shisha travels through the hookah bowl supporting the shisha, and into a volume of water, wherein it is cooled prior to be drawn through a hose or tube and into the user's mouth. The temperature of the smoke is reduced and contaminates are further captured as it passes through the water within the bowl. The user can then enjoy the flavor of the shisha before exhaling the smoke and returning for a subsequent draw.

Hookah smoking devices have familiar design elements and structural features that are well described in the art. The devices themselves have been used for centuries for the purposes of slowly burning a quantity of shisha. The elements that comprise a standard hookah include a bowl structure that supports a quantity of shisha and charcoal used for shisha combustion, a hookah body that allows smoke to be directed through a body of water contained within an attached water jar, wherethrough finally the smoke is drawn into a hose or tube from the water jar and towards an inhaling user. A valve attached to the device allows stagnated smoke to be cleared from the hookah body and water jar, removing stale smoke that has been inside the hookah for an extended time between smoking periods. The present invention is related to the bowl of the hookah, and more particularly to the packing of shisha thereinto prior to its ignition and subsequent inhalation. More specifically, the present invention provides a prepackaged quantity of shisha that allows for packing a hookah bowl and controlling the density of the shisha therewithin prior to and during its use without requiring the user to physically contact the shisha itself while preparing the bowl, which is otherwise a messy process that can stain a user's hands and clothing if not handled properly.

2. Description of the Prior Art

Current methods of loading a hookah bowl with a quantity of smokable material are inefficient, cumbersome and dirty. Typically, the material is placed into the bowl using either the user's fingers or a set of tongs, wherein the quantity and compaction thereof is determined by the user. The user is required to physically transfer the shisha from its originating container to the bowl, which can lead to inconsistencies in its compaction and forces the user to either physically handle the shisha or use a tool to do so. Once the shisha has been transferred, the bowl is generally covered by a foil layer, which is cut and sized for the particular bowl prior to be secured around its rim. After the foil is secured and formed over the bowl rim in an air tight configuration, so as not to let any unwanted air escape or be drawn through the sides of the bowl inlet, the foil is perforated using a knife or similar piercing tool. Burning coals are then placed over the foil, wherein heat transfer through the foil and foil perforations begins to ignite the shisha as air is drawn through the perforations, which is drawn by the user puffing the terminal end of the hookah hose. Particular skill or experience is required by the user for these operations, which are time consuming, messy and largely inconsistent. To place a uniform quantity and density of shisha into the bowl, an improved and more convenient method or device is needed. The present invention is disclosed for providing such a device, wherein many of the aforementioned steps are bypassed and direct application of coals onto a prepackaged capsule of shisha is possible. The disclosed device provides superior convenience and utility over the traditional methods of preparing a hookah bowl.

The present invention discloses a sealed package of shisha or similar smokable material, contained within a shaped capsule having an upper inlet and a lower outlet. The upper inlet comprises a perforated screen covering that allows coals to be placed thereon and air to be drawn therethrough, while the lower outlet is a perforated base that allows airflow through the capsule and its internal contents and into the hookah body. The capsule is provided for the user in a sealed configuration, wherein the inlet and outlet are hermetically sealed using a removable seal that protects the capsule contents prior to their use and over a prolonged period. A tab is provided on the seal, which the user utilizes to peel the seal from the capsule upper and lower inlet prior to placement in a bowl and smoking. The capsule can be placed directly into a bowl without requiring the user to manually pack it, cover it with a layer of foil and perforate the foil prior to placement of burning coals thereon. Considerable time and effort is removed utilizing the present invention, allowing the user to more rapidly access and enjoy the shisha over traditional methods and techniques. Further disclosed within the present invention shisha capsule is an internal agitator means, comprising an object within the capsule utilized to agitate, de-clump or otherwise disturb or separate the shisha within the capsule prior to its use, and as it burns and looses volume. By providing an agitator means, the user is allowed to evenly distribute the shisha within the capsule upon shaking the capsule before use, which ensures uniformity within the capsule for even burning and improved airflow therethrough. Blockages and clumping are prevented, along with non-uniformities with regard to its compaction. The agitator means is utilized by the user shaking the capsule prior to its placement in the hookah bowl. In this way, the density of the shisha within the closed capsule is controllable by the user to ensure even burning and provide uniform passage of air therethrough.

Several devices have been disclosed and patented in the prior art related to prepackaged quantities or containers of tobacco. Some of these devices are directly related to hookah smoking, while others are related generally to the field of smoking pipes. While these devices are well suited for their particular requirements and fulfill a goal or need in the art, they fail to disclose a prepackaged capsule of shisha having the disclosed elements of the present invention, and further fail to provide a similarly convenient and useful means of packing a hookah bowl without physically handling or manipulating the shisha prior to its smoking. The prior art devices lack the ability to disturb or ensure uniformity of the shisha within a capsule prior to its use and as it burns, which is provided herein by the present agitator means. Access to the burning shisha within the currently available shisha packages is therefore limited or nonexistent, wherein any clumping or separation of flavoring from the tobacco cannot be controlled without opening the capsule. Opening the capsule would compromise its structure and thus would defeat the prepackaged capsule purpose. A clear need exists in the art for a means to control the shisha density and compaction within the sealed capsule, as no currently disclosed tobacco pouches provide such a feature. The present disclosure fulfills a long felt need in the art related to prepackaged tobacco and shisha containers by providing this element, advancing the art of such devices and providing a novel device for hookah and pipe smoking users.

The prior art devices have familiar design and structural elements for the purposes of storing a pre-measured amount of tobacco; however they are not adapted for the task of ensuring freshness of the encapsulated smokable material and for providing a means to control the contents therewithin. They similarly fail to disclose the unique structural elements of the disclosed shisha capsule.

Specifically, U.S. Patent Application Publication No. 2007/0215164 to Mehio discloses a disposable hookah bowl having a moisture seal for protecting an inner compartment of tobacco. The bowl comprises an upper heat inlet and a lower, particulate screening outlet that allows heated air to flow through the bowl and draw smoke therethrough. Particulates are trapped by the lower screen, while the seal protects the tobacco quality prior to its use. The bowl further comprises an interior combustible product, such as massell. While suited for providing a complete bowl and tobacco chamber that is removable and replaceable, the elements of the Mehio disclosure fail to describe the structure and intent of the present invention, wherein a prepackaged, sealed and preferably pre-perforated tobacco capsule is disclosed for using in any existing bowl structure.

U.S. Pat. No. 3,792,704 to Parker is another such device wherein a tobacco pipe smoking system is disclosed. The system comprises a tobacco capsule and a tobacco pipe that are mutually designed to conform and operate together. The pipe includes a bowl and stem, while the capsule comprises a charge of particulate smoking tobacco within a sheath of imperforate incombustible sheet material, wherein smoke is communicated through a passageway along the bottom thereof. While the Parker device provides a unique packaging for pipe smoking, it is limited to a pipe that is specifically designed to accommodate the capsule of tobacco. The capsule is not adapted for use with a hookah, for the same purposes or engendering the same spirit as the present invention.

Similarly, U.S. Pat. No. 3,545,449 to Pecor describes a pipe smoker's package including a container and a charge of tobacco of size and shape to fit within the bowl recess of a standard pipe bowl. The package has a generally cylindrical shape, a flat sheet of metal foil on its upper surface and perforations about its domed lower surface. As with the Parker device, the Pecor device is suited for use with deep pocket bowls of a standard, handheld pipe. Its use is limited to such structures, and teaches away from use with a hookah.

U.S. Pat. No. 4,944,317 to Thal discloses a tobacco portion enclosed within a metal foil cup, wherein the shape of the cup is adapted to conform to the inner cavity of a handheld pipe bowl. The cup includes a removable sealing means to preserve the flavor content and freshness of the tobacco if stored for extended periods of time. The Thal device shares the same drawbacks as the Pecor and Parker devices, wherein its use is limited to being utilized within a handheld pipe bowl. The elements of the Thal device include a perforated lower surface formed on a frusto-conical section thereof, joining with a largely cylindrical sidewall and an open top for accessing and lighting the tobacco contents. No mention is made of an agitator means therefor. Rather, the open top allows control of the tobacco compaction, but limits its use and teaches away from slower burning hookah shisha and its method of burning, wherein burning coals are placed above the shisha to burn and draw smoke therefrom.

U.S. Patent Application Publication No. 2008/0060663 to Hamade discloses a disposable hookah tobacco capsule. The capsule comprises an upper foil layer and a lower foil layer. These layers define an interior space for retaining a volume of tobacco. The rim of the capsule is disposed at the junction of the upper and lower layers and is bendable. The shape of the capsule rim is held flat by an annular ring prior to use of the capsule. When the capsule is placed within the head of a hookah pipe, the bendable foil rim is folded over the edges of the head. Holes may then be punched into the foil layers of the capsule to allow heat to permeate the tobacco and smoke to exit the capsule. Hamade does not disclose perforations of the foil layers nor does it disclose a removable seal for ensuring freshness. Hamade also fails to contemplate the inclusion of an agitator or similar object within the tobacco to allow user to disturb and loosen the burning tobacco for means of additional airflow therethrough and prevention of clumping. Further, the capsule of Hamade is distended from its rim area, which does not provide a flat region for placement of coals. This creates a hazard for a hookah smoker, wherein the coals can easily fall from the capsule while smoking, which is disrupting and potentially dangerous. The elements of the present invention make it a better suited application for providing a fresh, rich smoking experience that eliminates clumping of the inner capsule contents and one with a flat upper region for placement of burning coals during use.

Several U.S. Published Patent Applications to Saleh, Publication Nos. 2010/0126518, 2010/0252057, and finally 2011/0186060 are all related to a disclosure for a tobacco container adapted for a hookah, wherein the container provides a sealed capsule for the shisha prior to its use. The elements of the capsule are adapted to conform over the sidewalls of the hookah bowl, in a similar fashion as the Hamade device. The capsule comprises a flange that is adapted to be of larger radius than the upper rim of the bowl, allowing the flange to be folded thereover. The capsule can then be punctured to allow airflow and coals are placed thereonto. The Saleh devices fail to disclose a dedicated screen inlet or perforations thereon, along with perforations on the capsule lower surface. The present invention provides such a pre-perforated structure, wherein the upper surface is adapted to form a screen for supporting burning coals and allow airflow into the capsule while the lower perforations allow airflow and smoke from the capsule. The perforations are initially sealed by a sealing means to retain freshness. More specifically, the Saleh device, along with all of the aforementioned disclosed devices, fail to disclose an agitator means or shisha density control means within the capsule assembly for controlling the consistency of the shisha or tobacco prior to and while smoking. This feature is a critical component to controlling the burning properties of the shisha, and for allowing access to the shisha when a pre-formed package thereof would otherwise limit such access.

It is therefore submitted that the devices disclosed by the prior art do not address the need for maintaining a volume of tobacco that is fresh and evenly packed within a disposable and sealed pouch or capsule. The present invention relates to a device for providing a pre-measured amount of packaged, fresh tobacco to smoke using a hookah device. The structure and construction of the device, along with its internal agitator element, substantially diverge in structural and conceptual elements from the prior art; consequently it is clear that there is a need in the art for an improvement to the existing hookah tobacco capsules and smoking systems. In this regard the instant invention substantially fulfills these needs.

SUMMARY OF THE INVENTION

In view of the foregoing disadvantages inherent in the known types of prepackaged tobacco capsules, pouches and smoking systems now present in the prior art, the present invention provides a new prepackaged and sealed shisha capsule and means for interacting with the capsule interior contents without resorting to physical contact therewith, wherein the same can be utilized for providing convenience for the user when readily packing a hookah bowl or pipe with a fresh, evenly distributed and loosely compacted quantity of smokable material.

The present system comprises a capsule having sidewalls, an upper inlet surface and a lower outlet surface. Within the capsule is enclosed a pre-measured amount of loose smokable material such as tobacco, shisha or other variety of moisture-rich, flavored tobacco. The shape of the capsule is adapted to allow its placement within a bowl structure of a hookah or pipe, while allowing coals to be placed on its flat upper surface. Prior to use, a freshness seal is removed from the upper and lower portions to reveal the pre-perforated upper inlet and lower outlet surfaces that allow air to pass through the capsule interior.

Within the capsule and internal shisha is provided an imbedded agitator means or shisha density control element. This device is used to ensure the shisha remains loosely packed within the capsule prior to ignition and prevents clumping. It further allows mixing of shisha with any flavoring that may have separated therefrom within the capsule. Upon shaking or disturbing the capsule, the agitator mixes the shisha prior to use and separates any clumps. During use, the agitator is used to maintain uniform burning and a maintained airflow through the shisha as it burns, loses volume and develops ash. The agitator means may be any physical object having a shape and placed within the shisha to facilitate shifting of tobacco and prevent clumping thereof. Shifting prevents the tobacco from sticking together in higher density clumps, as the dried leaves absorb moisture and form together in certain locations within the capsule interior. The sealing of the capsule prevents drying of the tobacco over a prolonged period and thus this occurrence, while the agitator is used to ensure a uniform density therewithin prior to its use. The disclosed agitator feature provides a significant improvement over the prior art by facilitating even burning and a smoother smoking experience for the user. Evenly distributed contents within the capsule allow even burning and prevent increased draw effort on the hookah by the user that may otherwise be required to maintain burning of condensed portions the capsule contents.

The upper inlet and lower outlet are centrally perforated to permit heat to enter through the top of the capsule, and smoke to exit through the bottom of the capsule. Pre-perforating the capsule reduces the likelihood that users will not poke enough or an adequate pattern of holes into the capsule prior to use. Additionally this pre-perforation facilitates the ideal placement of holes by a manufacturer so that users will experience less preparation time prior to enjoying smokable contents. An adhesive seal is removably secured over the inlet and outlet to ensure freshness of the enclosed shisha, preventing the shisha or flavoring from falling through the perforation prior to use. The adhesive seal is further embossed to fill and seal the pre-perforated holes to ensure an air tight freshness seal. The addition of pre-perforated areas on the capsule makes it easier to use than the capsules disclosed in the prior art, and the removable seal prevents any loss of freshness to the tobacco. An alternative embodiment of the capsule does not provide pre-perforated surfaces, but allows the user to puncture the capsule as desired.

Additionally, a retainment system for the disclosed shisha capsule is disclosed, wherein the system includes a bowl for a hookah and a levered clamping ring. The bowl includes an outer wall that defines tapering, hour glass configuration adapted to support the prepackaged capsule along its upper region, and provides a central neck, before transitioning to an outwardly expanding lower section. The upper region is adapted to retain and support the outer wall of the capsule. The rim of the capsule rests on the upper edge of the bowl and is removably secured thereonto by the levered clamping ring, which secures over the capsule upper surface periphery above the bowl upper edge. This clamping ring is a hinged member that connects to a lower clip positioned around the exterior of the bowl neck region. The clamping ring is secured into place over the bowl upper edge by a lever arm exerting a load that compresses capsule against the bowl while the ring is drawn towards the lower clip positioned at the neck of the bowl. When a user is finished smoking, the securing ring may be unhinged to allow the capsule to be removed and replaced. The retainment system and bowl disclosed herein is an example embodiment of a hookah bowl that is particularly suited for use with the disclosed capsule, facilitating the capsule seating position within the hookah bowl and utilized as intended in connection with a hookah device.

It is therefore an object of the present invention to provide a new and improved prepackaged smokable material capsule and smoking system having all of the advantages of the prior art and none of the disadvantages.

Another object of the present invention is to provide a new and improved prepackaged smokable material capsule and smoking system adapted for use with a hookah smoking apparatus.

Another object of the present invention is to provide a new and improved prepackaged smokable material capsule having an upper inlet surface, a lower outlet surface and sidewalls adapted to conform to a hookah bowl.

Another object of the present invention is to provide a new and improved prepackaged smokable material capsule having a removable sealing means covering any perforated areas of the capsule, ensuring freshness and moisture retainment of the smokable material prior to use.

A primary object of the present invention is to provide a new and improved prepackaged smokable material capsule having an internal agitator or density control means, wherein control to the shisha density and compaction within the capsule is permitted using a means to disturb or loosen the smokable material prior to use and while smoking.

Still another object of the present invention is to provide a new and improved prepackaged smokable material capsule providing a measured quantity of smokable material, tobacco or shisha in a loosely packed and readily smokable proportion.

A further object of the present invention is to provide a new and improved smoking system having a hookah bowl and prepackaged capsule retainment means adapted to receive and retain the disclosed smokable material capsule and communicate smoke therethrough.

A still further object of the present invention is to provide a new and improved smokable material capsule and retainment system having resilient and durable construction.

Other objects, features and advantages of the present invention will become apparent from the following detailed description taken in conjunction with the accompanying drawings.

BRIEF DESCRIPTIONS OF THE DRAWINGS

The above invention will be better understood and the objects set forth above as well as other objects not stated above will become more apparent after a study of the following detailed description thereof. Such description makes use of the annexed drawings wherein like numeral references are utilized throughout.

DETAILED DESCRIPTION OF THE INVENTION

Figure 1:
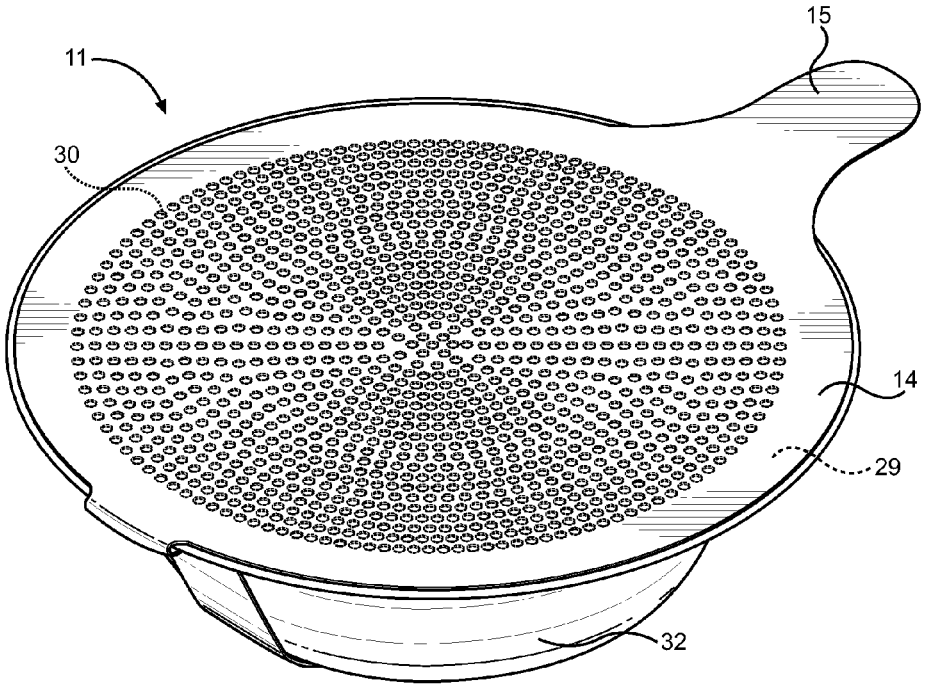
FIG. 1 shows an overhead perspective view of the smokable material capsule of the present invention.

Reference is made herein to the attached drawings. Like reference numerals are used throughout the drawings to depict like or similar elements of the hookah smoking system. For the purposes of presenting a brief and clear description of the present invention, the preferred embodiment will be discussed as used for providing fresh, loose smokable material to users, wherein the smokable material in the detailed description will be discussed as being shisha for use in a hookah device. Discussion of shisha and a hookah smoking device is not intended to limit the use of the present invention to this particular type of smokable material and smoking device therefore, but is intended for clarity, ease of description and for representative purposes only.

Referring now to FIG. 1, there is shown an overhead perspective view of the disclosed smokable material capsule of the present invention, wherein a quantity of shisha is housed therein. The capsule 11 comprises an upstanding container having sidewalls 32 adapted to conform to and rest against a smoking device or hookah bowl interior surface. The capsule further comprises an upper surface 29 forming an inlet, a lower surface forming an outlet and an internal volume for housing a quantity of shisha. The shisha is adapted to be prepackaged within the interior of the capsule and distributed as an assembly to a user, allowing the user to place the capsule into a hookah bowl without physically manipulating or contacting the shisha, or further utilizing a tool to transfer shisha from a first container and into the hookah bowl. The upper inlet surface 29 and lower outlet surface of the capsule are preferably perforated surfaces, wherein a plurality of apertures 30 are provided in a defined pattern therethrough for allowing heat and air into and through the capsule internal volume. The inlet surface 29 may be constructed of a screen material or a perforated surface, wherein burning coals are placed thereonto to allow heat penetration and transfer to the internally housed shisha, and further allowing air to pull through the capsule as a user draws from the hookah.

Placed over the perforated inlet and outlet surfaces of the capsule is a sealing means 14, which comprises an air tight, removable seal covering the surface apertures 30 to prevent air infiltration and subsequent drying out of the shisha. The freshness of the shisha is therefore preserved, as air, moisture and liquid flavoring are prevented from leaving or entering the capsule. This ensures the quality of the shisha after prolonged storage and prevents spoilage or excessive drying out. The seal covers both the inlet 29 and outlet surface in a single piece construction that connects both seal members and is peeled in a continuous fashion. Alternatively, the inlet and outlet seals are disconnected members that are individually removed prior to utilizing the capsule. The seal comprises an adhesive underside surface adapted to be in contact with the capsule inlet or outlet, which is fully peelable therefrom without leaving residual adhesive residue on the capsule surfaces after removal. A clean inlet and outlet surface is desired to prevent burning of any noxious adhesive that may be left over from the seal, which is potentially hazardous if burnt and inhaled by the user. A tab 15 is further provided for removing the seal from the capsule and extends outward from the periphery of the capsule. The user grasps the tab to peel back the seal and reveal the inlet and outlet surfaces. Once removed, the shisha aroma is allowed to exit through the apertures 30 and the capsule can be placed into a hookah bowl for use.

Within the interior of the capsule is housed an internal agitator means and a quantity of smokable material. The agitator means is an object or structure that is adapted to physically de-clump and disrupt the contents of the capsule prior to its use and subsequent placement in a hookah bowl. The interior contents of the capsule are securely housed therewithin, preventing physical access to the shisha using a tool or user contact without compromising the capsule structure. To ensure uniform distribution of the shisha, loose compaction and mixing of any flavoring that may have separated from the shisha, the capsule is shaken to engage the agitator means. Prior to the seal being broken by the user, the capsule is shaken, thereby causing the agitator to remove densely clump portions of the shisha, mix the flavoring and ensure uniform consistency.

Sealing of the capsule is provided by an adhesably releasable cover that is applied via an ultrasonic welding process that mates the periphery of the cover to the rim of the capsule during assembly. Alternatively an adhesive bonding around the periphery of the seal creates removable connection therebetween. The free field area of the seal covering the perforations is adapted to create an air tight seal on the perforations, wherein the seal is embossed or otherwise depressed into each perforation, filling or plugging the perforated apertures and affecting an air tight seal thereon. The seal is releasable about its weld line or adhesive connection, allowing the upper surface inlet and lower surface outlet to be revealed prior to being utilized in a smoking device. The seal is preferably a foil material, but may assume any material deemed suitable by one skilled in the art of air tight freshness seals.

Figure 2:
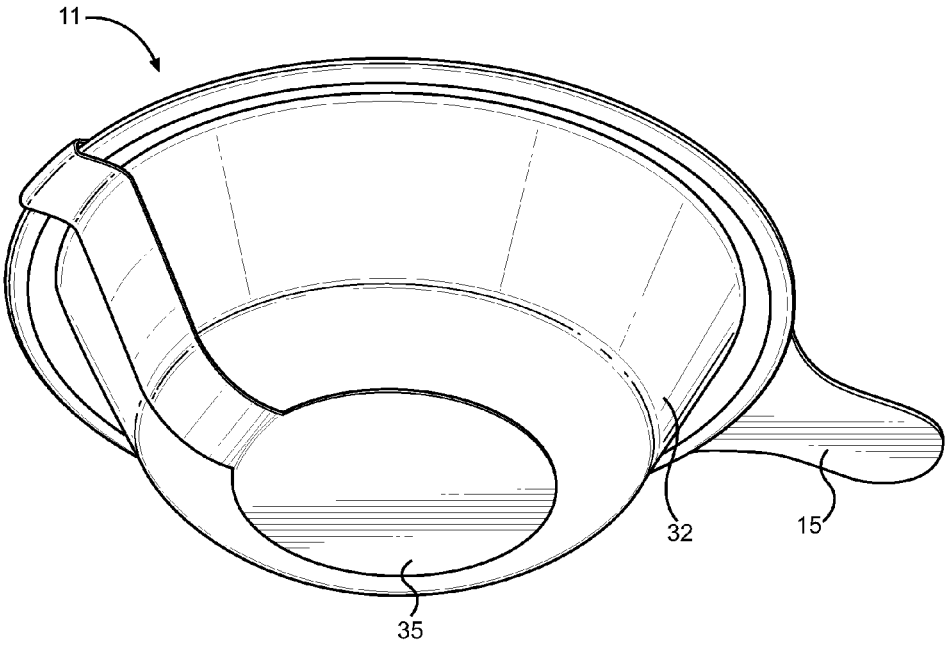
FIG. 2 shows an underside perspective view of the smokable material capsule of the present invention.

Referring now to FIG. 2, there is shown an underside perspective view of the shisha capsule 11 of the present invention, wherein the seal is shown in a continuous embodiment. The upper inlet surface and lower outlet surface 35 of the capsule 11 are covered by the seal to prevent air leaking from or entering into the capsule internal volume. In this embodiment, the seal provides a removal tab 15 and a connecting strip between sections of the seal to allow the user to remove the entire sealing means in one continuous fashion. Also shown are the sidewalls 32 of the capsule, which extend from the lower outlet surface 35 to the capsule upper surface. It is desired to allow the capsule to take several forms and geometric shapes, based on its intended use and the particular style necessary for placement into a smoking pipe or hookah bowl. The capsule is designed to completely cover the inlet opening of a pipe or bowl when placed therein, which prevents air from bypassing the capsule and diluting the smoke entering the pipe or hookah body. In a particular embodiment, the sidewalls 32 of the capsule mate with the capsule upper surface and form an outwardly extending lip or radius that is adapted to overhang a bowl upper rim and act as an air tight ledge when air is being drawn through the capsule. In this way, when placed into the bowl the capsule is adapted to create a seal on the bowl, wherein if a user draws from the hookah having a sealed capsule loaded therein, a vacuum would be created within the hookah. It is not desired to limit the design of the present capsule to a specific geometry, size or exterior sidewall contour, but rather it is desire to disclose one with an upper inlet and lower outlet having a connecting sidewall therebetween that affects a seal over an open pipe or bowl inlet.

Figure 3:
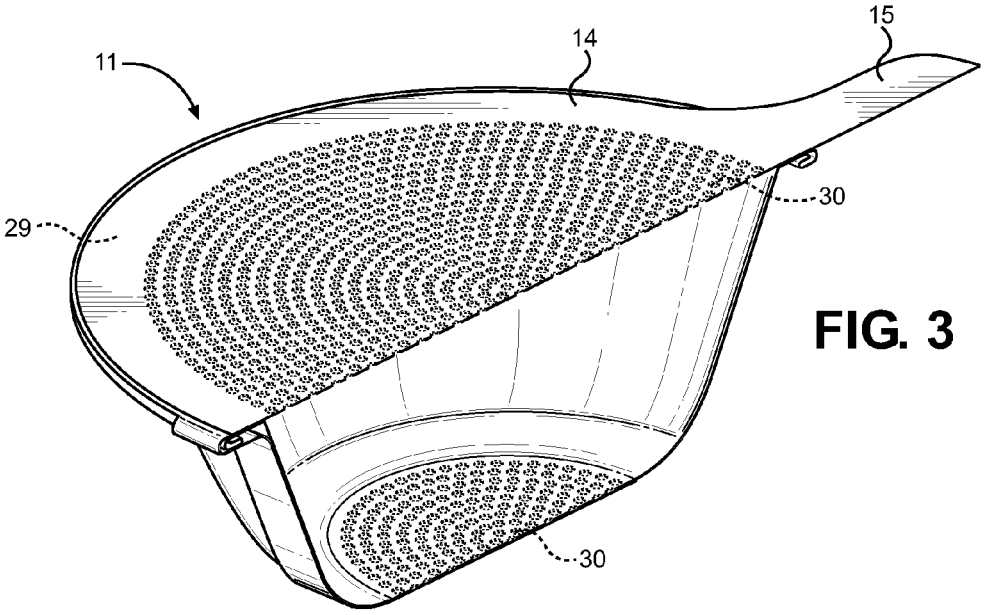
FIG. 3 shows a perspective cross section view of the smokable material capsule of the present invention.

Referring now to FIG. 3, there is shown a perspective section view of the disclosed shisha capsule of the present invention, wherein the capsule is sectioned in half to visualize its interior volume. As shown, the capsule interior volume is defined between the upper inlet 29, lower outlet and sidewalls of the capsule structure, which houses a quantity of smokable material therein. Also within the cavity of the capsule is an internal agitator means, wherein the compaction, positioning and mixing of the shisha may be controlled by the user without opening the capsule and directly accessing its contents.

Figure 4:
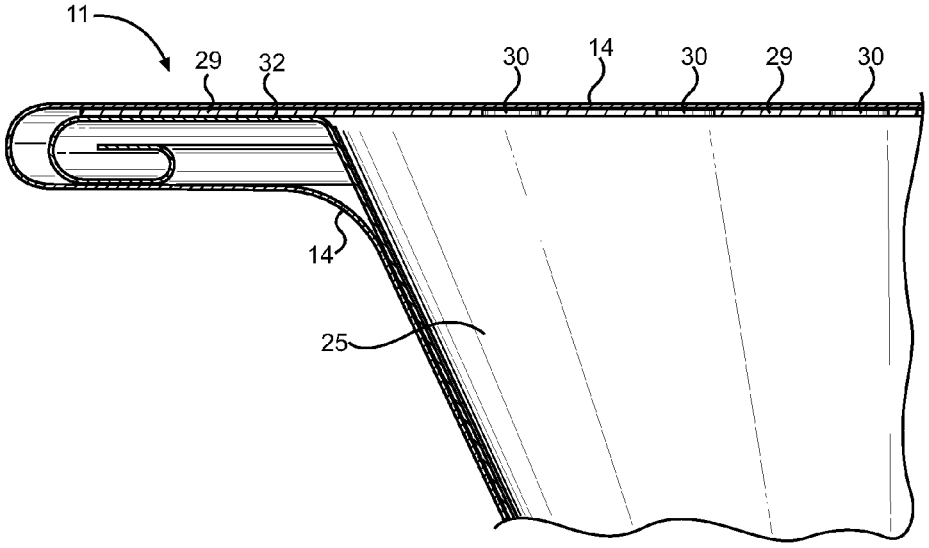
FIG. 4 shows a cross section cut along the upper rim of the smokable material capsule, including its construction.

Referring now to FIG. 4, there is shown a cross section cut along the upper rim of an exemplary embodiment of the shisha capsule, highlighting its construction and layup of materials that seal the device prior to use. In this embodiment, the inlet surface 29 is an apertured screen or perforated surface that connects periphery edges of the capsule sidewalls 32, wherein the sidewall 32 transitions into a ledge for support of the inlet surface 29 thereabove. Perforations or apertures 30 are provided through the inlet surface 29, and are then covered by a seal 14 that covers both the inlet surface 29 and then wraps around the capsule sidewall 32 before covering the outlet surface. The capsule interior 25 is then sealed, allowing the shisha to remain inside without risk of drying, developing mold or otherwise losing freshness. This is of particular concern, as the capsules may be sold in large quantities and not immediately be utilized. Extended shelf life may be required to meet a need in the market, wherein the shisha does not decay or lose it quality when unsealed and subsequently smoked.

Figure 5:
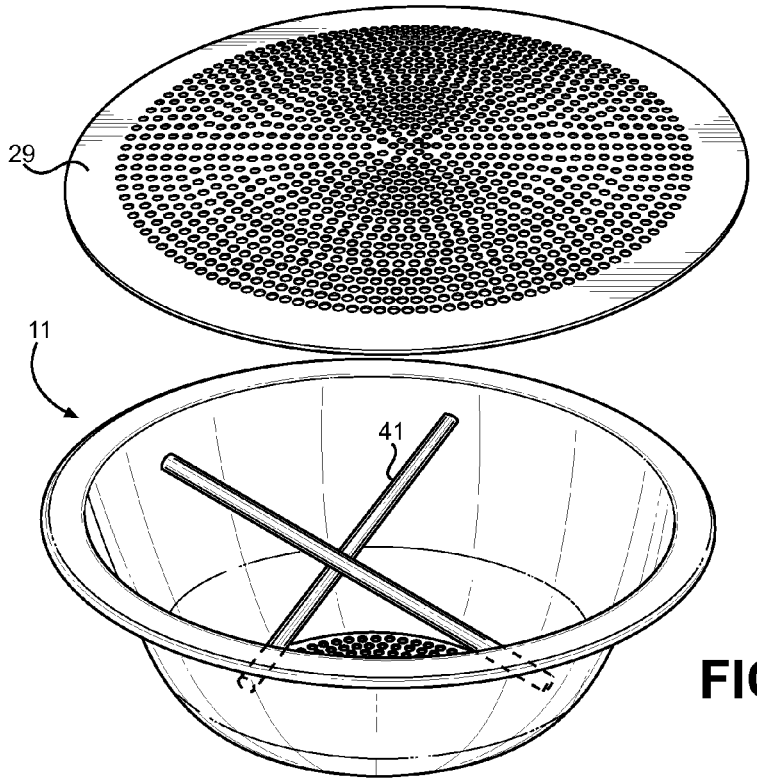
FIG. 5 shows an exploded perspective view of the capsule and an embodiment of the internal agitator means.

Referring now to FIG. 5, there is shown a perspective view of an embodiment of the agitator means within the interior of the capsule 11. The inlet surface 29 is shown in an exploded configuration and not attached to the capsule for clarity purposes. In this embodiment, a rigid cross member 41 is loosely positioned within the capsule interior volume. This member 41 is adapted to contact the shisha contents as a user physically shakes the capsule. The shisha tobacco is loosely packed within the capsule and therefore can move within its interior. The member 41 breaks up any large clumps therein and provides a more uniform distribution throughout the capsule. Heavier clumps carry more momentum when shook, and therefore are forced into contact with the member more readily that the loosely packed shisha. This facilitates the separation of large clumps and allows loose contents to settle in a uniform fashion across the interior prior to be ignited and smoked. This embodiment of the agitator 41 is ideally a metallic member that can withstand the high heat involved with being placed within the burning shisha without melting, burning or producing noxious fumes.

Figure 6:
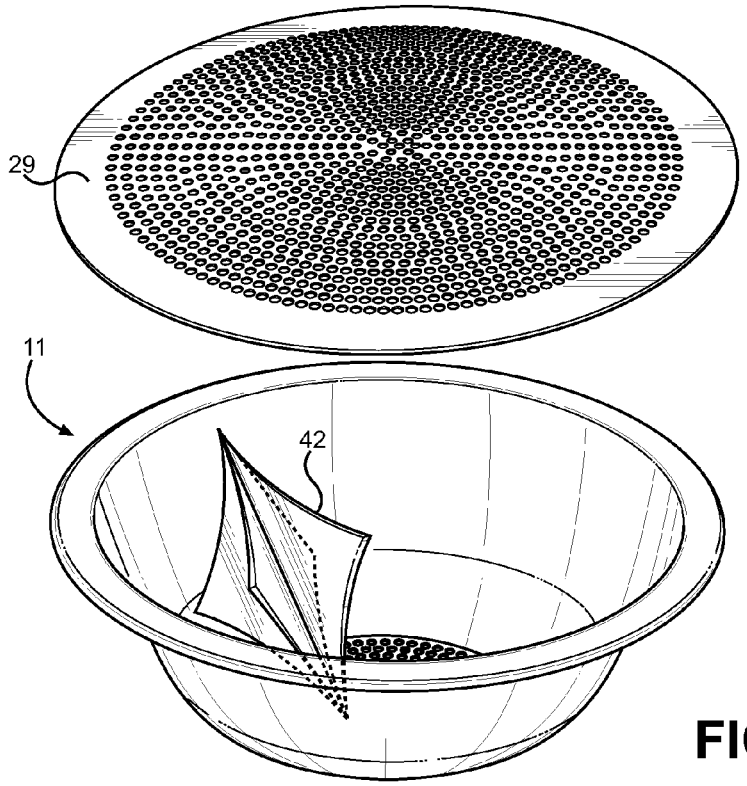
FIG. 6 shows an exploded perspective view of the capsule and an embodiment of the internal agitator means.

Referring now to FIG. 6, there is shown another exploded perspective view of the present invention, wherein another embodiment of the internal agitator means is provided. In this particular embodiment, a geometrically shaped agitator object 42 is provided that is adapted to be freely placed within the capsule interior and imbedded within the shisha. The shape of this embodiment includes a three-dimensional star shape with protruding flanges or extensions to disturb and shuffle the capsule interior contents when shook. The extended flanges and large surface area of this particular shape, or one of different geometry but with flanged elements, breaks up condensed pockets of the shisha as the object is thrown about the interior of the capsule as the user shakes the device back and forth. The object is adapted to be of considerable mass with regard to the shisha or anticipated clumping thereof, such that the larger mass object breaks the clumping into smaller or loosely compacted consistency material.

Figure 7:
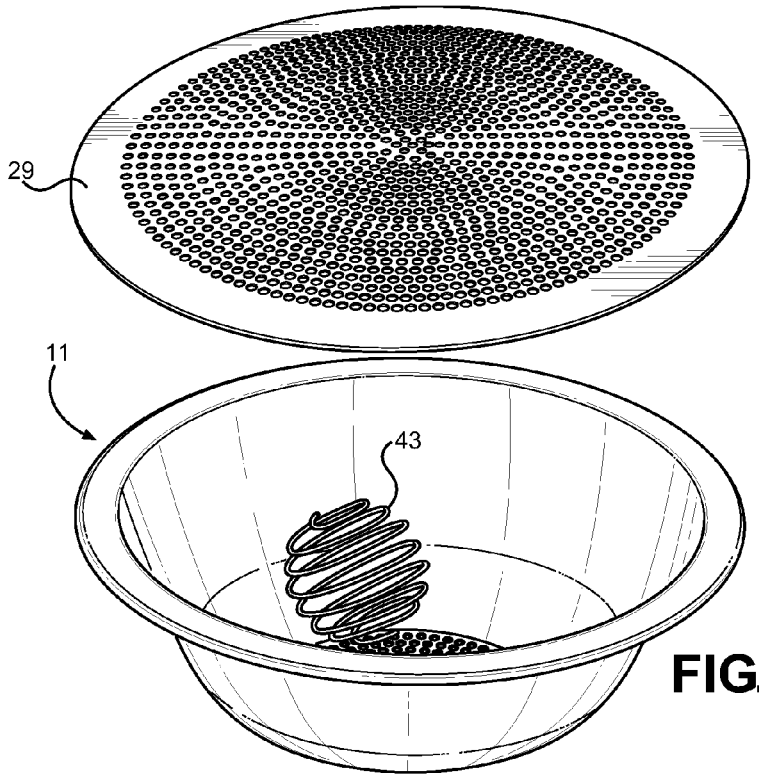
FIG. 7 shows an exploded perspective view of the capsule and an embodiment of the internal agitator means.

Referring now to FIG. 7, there is shown a third exploded perspective view of the present invention, wherein another embodiment of the internal agitator means is provided. In this embodiment, the agitator is provided in a circular coil shaped configuration 43. This device is adapted to provide a plurality of outer rings for which to contact and break up clumps of shisha within the capsule. The open interior and coiled configuration provide a large surface area, while the thinly coiled members provide a means to eliminate large clumps and uniformly distribute the shisha when the capsule is shaken by the user.

Figure 8:
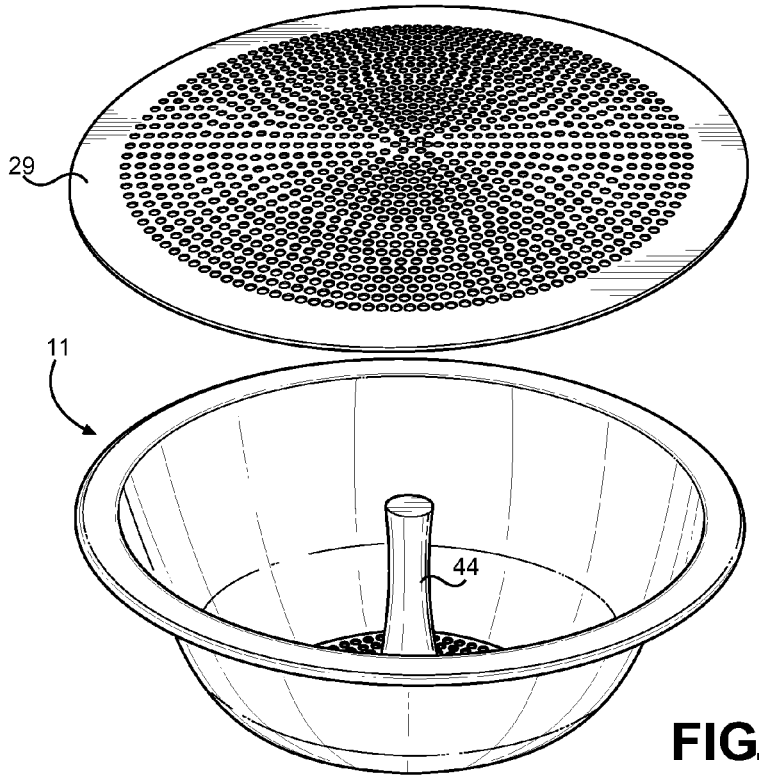
FIG. 8 shows an exploded perspective view of the capsule and an embodiment of the internal agitator means.

Referring now to FIG. 8, there is shown a final exploded perspective view of the present invention, wherein another contemplated embodiment of the internal agitator means is provided. In this embodiment, an upstanding post 44 is provided within the capsule that protrudes from the outlet surface toward the inlet surface. One or more posts may be provided within the agitator to serve in place of a floating object within the capsule, while serving the same purpose of removing clumps, mixing separated shisha with its flavoring and uniformly distributing the shisha about the interior of the capsule when shaken by the user.

The agitator provides a means to interact and mix the internal contents of the capsule without opening the capsule by breaching its structure. This element is a crucial component for an encapsulated quantity of smokable material, as the material compaction and its positioning within the capsule is a prime factor in the burn qualities and the ability of a user to draw from the capsule. Uniformity and loosely compacted material ensures consistent and continual burning of the material while the user is smoking. Material that is too compacted will be difficult to ignite, while pockets of dense material will cause non-uniform burning and possible ceasing of the material burning. Further, the ability to draw air through the material is greatly affected by its compact and distribution. Dense pockets or tightly compacted material is harder to draw from, and thus stunts the burning process, and therefore the smoke generated therefrom. Finally, tobacco flavoring can separate from its substrate. Proper mixing of the material with any separated flavoring ensures the flavoring is produced while the material burns, improving the quality and taste of the smoke product for the user.

These factors are easily controlled with a traditional hookah bowl, wherein the shisha material is manually packed and placed within the hookah bowl by the user just before smoking it. Use of a capsule, as described by some devices in the art, eliminates the user's ability to control the consistency and constitution of the capsule interior contents without opening the capsule. The imbedded agitator means of the present invention is intended to advance the field of smokable product capsules, wherein the contents of the capsule can be more easily controlled and manipulated prior to being and while smoking. The agitator provides a higher mass object, post or geometric shape within the capsule that is adapted to mix and separate the capsule material as the capsule is shook back and forth. The agitator will move within the capsule between its sidewalls and break up any clumps and more evenly distribute the internal material.

Figure 9:
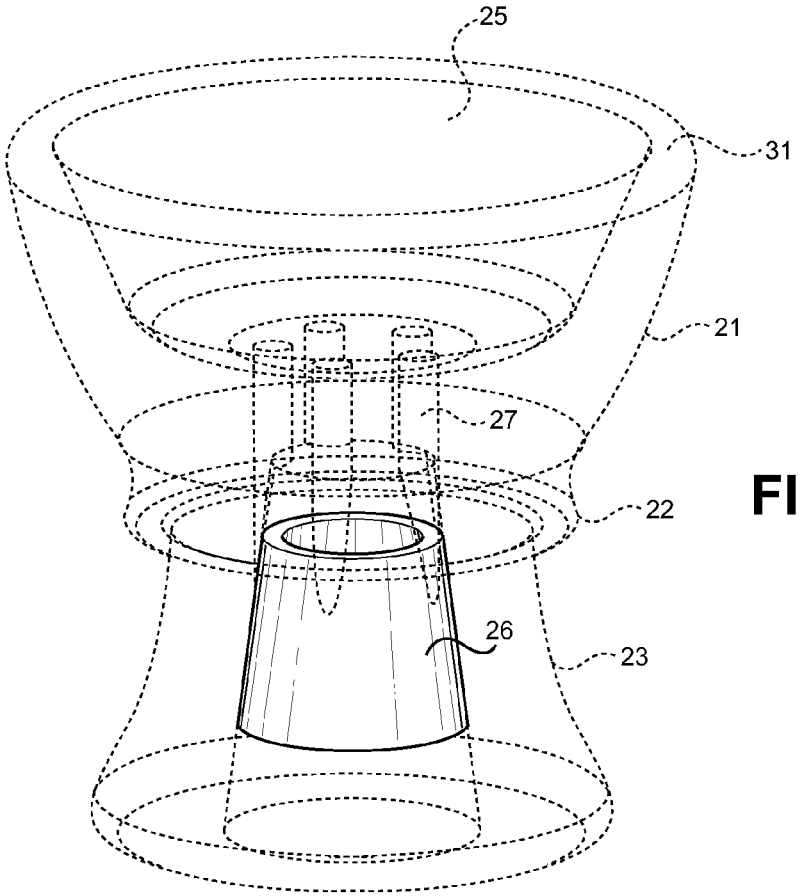
FIG. 9 shows a side perspective view of disclosed hookah bowl of the present invention and a view of its internal structure.

While primarily related to a smokable material capsule with imbedded agitator, the present disclosure extends to a hookah bowl device and a capsule retainment means that is adapted to work in concert with the disclosed capsule and allow intended application thereof on a hookah device. Referring now to FIG. 9, there is shown a perspective side view of an embodiment of the hookah bowl designed to support the present shisha capsule. The bowl is provided in hidden lines for clarity of its internal structure. The bowl comprises an hour glass shape having an outwardly tapering upper region 21 and lower region 23 centrally joined by a smaller diameter neck region 22. Centrally located through the interior of the bowl and extending vertically through its core are air pathways 27 connecting the upper 21 and lower 23 regions through the neck 22. These pathways 27 allow smoke and air to communicate through the bowl and into the hookah for intake by the user. The lower region 23 is adapted to connect to the body of a hookah, wherein the hookah mates against an interior grommet 26 placed in the bowl central pathway. The bowl upper region 21 is an interior open bowl shape 25 adapted to support the shisha capsule therein, wherein the bowl upper edges 31 support the outer edges of the capsule to create an air tight seal that only permits air to pass through the capsule when the user draws from the hookah. Internally, within the air passageways are preferably a plurality of air conduits 27 that allow smoke and air to pass therethrough from the upper region 21 to the lower region 23 of the bowl and into the hookah body. It is not desired to limit the disclosed bowl or the design of the capsule to a specific configuration, but rather to disclose a contemplated embodiment that permits the use of the capsule in conjunction with a hookah smoking device.

Figure 10:
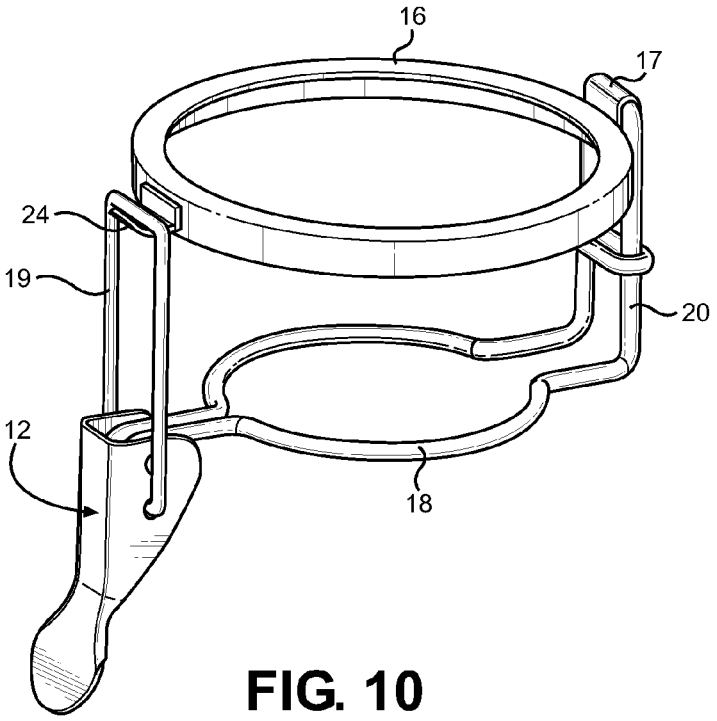
FIG. 10 shows a perspective view of the disclosed capsule retainment means adapted to conform to the disclosed hookah bowl.

Referring now to FIG. 10, there is shown a perspective view a capsule retainment means that is adapted to position and secure the shisha capsule against the disclosed bowl. The retainment means comprises a first upper ring 16 that is hingedly attached 17 an upstanding portion 20 of a bowl neck lower clip 18 that affixes around the neck of the bowl and is supported therefrom. Opposing the hinged connection 17 is a lever arm 19 that is adapted to connect to an outwardly extending flange 24 from the upper ring 16. The lever arm 19 depresses the upper ring 16 onto the bowl upper rim and draws the lower clip 18 and ring 16 together in a secure connection. The upper ring 16 is adapted to be placed above the periphery of a capsule inlet surface and secure the capsule against the bowl during use. The capsule can be discarded or replaced by lifting the lever arm release 12 and disengaging the lever arm 19 from the upper ring 16, wherein the ring can be rotated away from the bowl upper rim. The exact design and mechanics of the retainment means is not intended to be limited to the elements of the device in FIG. 10. Any device that is adapted to retain the shisha capsule against a bowl rim is contemplated. The particular embodiment described above is one contemplated design that is shown to be particularly suited for the task of securing the capsule. Alternatively, the capsule may be utilized without the disclosed bowl or retainment means, the capsule forming a seal on the bowl upper rim without using either the disclosed bowl or retainment means designs.

Figure 11:
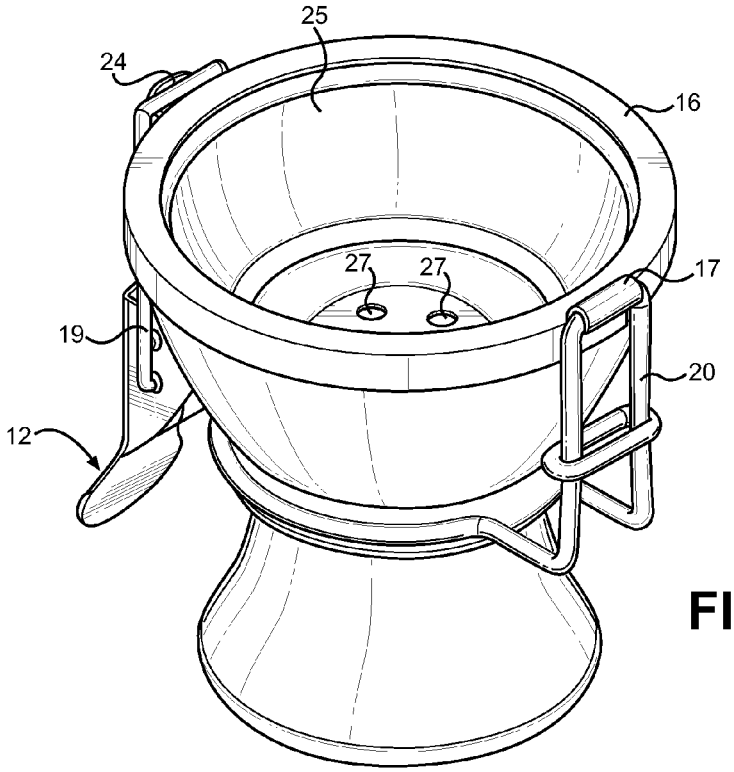
FIG. 11 shows an overhead perspective view of the disclosed hookah bowl and the capsule retainment means attached thereto.

Referring now to FIG. 11, there is shown a view of the disclosed hookah bowl and capsule retainment means in connection with one another in working position. When in operation the upper ring 16 of the retainment means secures over the upper lip rim of the bow upper portion and provides an open center for the inlet surface of the capsule to be positioned. This allow unobstructed airflow through the capsule and into the bowl, along with a region to rest burning coals that light the shisha and draw smoke therefrom. Air is passed through the inlet surface of the capsule, through the upper region of the bowl 25 and through the air passageways 27 in the neck of the bowl to the hookah body. The smoke enters the hookah and is drawn through a body of water before exiting through a pipe or hose and into a user's mouth for enjoyment thereof. Prior to placement of the capsule into the bowl and then clamped into place, the capsule is shook by the user to disrupt any clumps or dense regions of the capsule contents via the imbedded agitator means.

Figure 12:
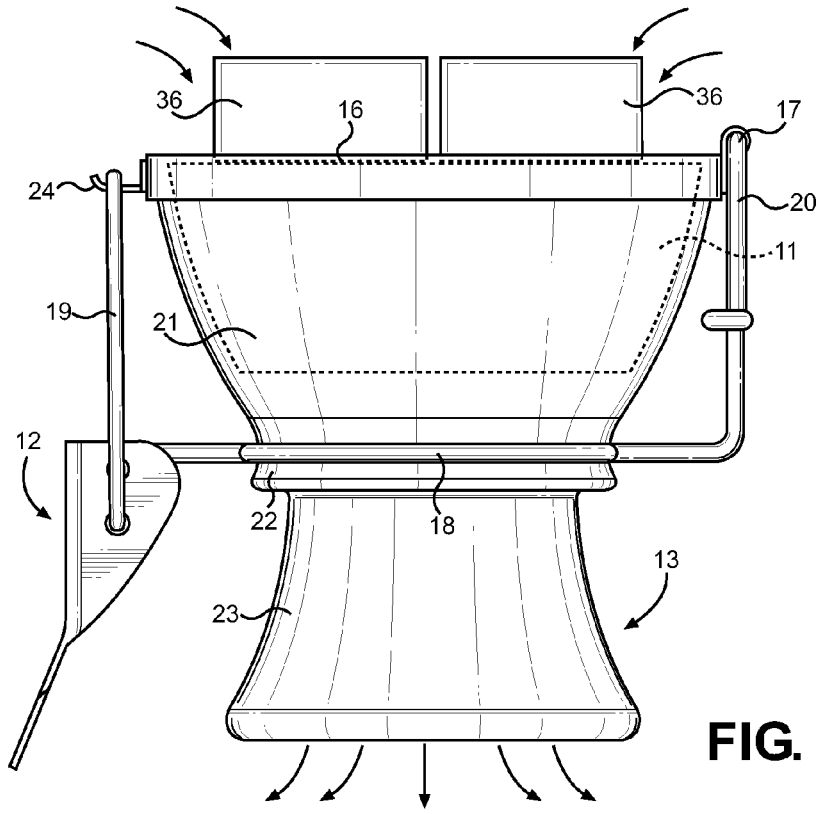
FIG. 12 shows a side view of the disclosed hookah bowl and capsule in a working position with burning coals positioned on the inlet surface of the capsule.

Referring now to FIG. 12, there is shown a side view capsule, hookah bowl and capsule retainment means in a working position, wherein a plurality of coals 36 are being utilizes to light and smoke the capsule shisha. Once the material within the capsule is sufficiently mixed and unclumped using the agitator means, it is placed on the bowl upper rim and secured using the elements of the retainment means. The use of the agitator means prior to placement in the bowl is critical to ensure the shisha is of uniform density within the capsule, thoroughly mixed with any flavoring that may have separated and is loosely compacted therewithin. Large clumps of compacted or colocated shisha makes for uneven burn rates and airflow through the capsule, increased draw effort from the user, and poor smoke generation from and combustion of the shisha. Ignited and burning coals 36 are placed onto the capsule inlet surface to begin heating the internal shisha. The user draws air through the assembly by sucking on the working end of the hookah hose, which draws air from the ambient environment through the coals and into the capsule, lighting the shisha an initiating burning thereof. Smoke generated from this process is drawn through the outlet of the capsule, through the bowl and into the hookah. After passing through the water jar of the hookah, the smoke enters the mouth of the user, wherein it is enjoyed for its flavoring.

Figure 13:
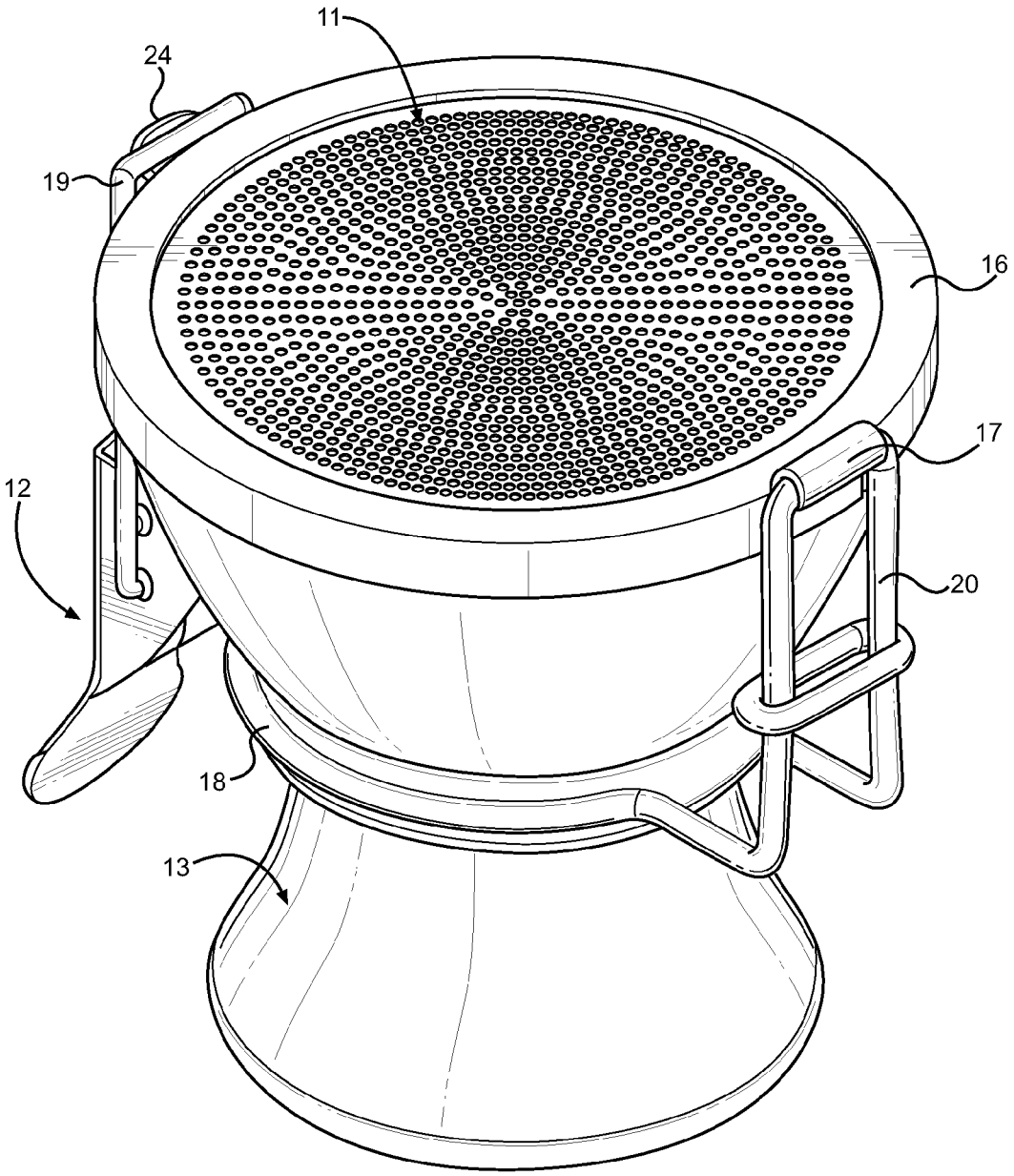
FIG. 13 shows overhead perspective view of the disclosed hookah bowl, capsule and capsule retainment means in a working position.

Referring finally to FIG. 13, there is shown an overhead perspective view of the shisha capsule and disclosed embodiments of the bowl and capsule retainment means in a completed assembly and in a working position. In a working position, the capsule 11 is positioned within the hookah bowl 13 and clamped into position. The outer flange of the capsule rests or is clamped onto the hookah bowl to create a seal. The inlet surface provides a flat surface for placing burning coals, while the apertures communicate the heat and smoke through the capsule and into the hookah bowl. The capsule is adapted to be used in any open hookah or pipe bowl with a rim for which to rest of capsule flange. The disclosed retainment means and bowl design are not intended to limit the functionality or modularity of the capsule, but rather it is desired to disclose an embodiment of a hookah bowl and a clamping mechanism that has been shown to operate well with the disclosed capsule and facilitate its use.

With regard to the present disclosure and in light of the prior art, it is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A prepackaged capsule of smokable material, comprising:

a container having an upper surface, a lower surface and sidewalls defining an enclosed internal volume;

a quantity of smokable material and a freely movable agitator within said smokable material;

said smokable material and said free agitator being encapsulated within said internal volume.

2. The device of claim 1, wherein said upper and lower surface further comprise a plurality of apertures to allow airflow through said capsule.

3. The device of claim 1, wherein:

said upper and lower surface further comprise a plurality of apertures adapted to allow airflow through said capsule;

said apertures being covered by a removable cover that affects an air tight seal over said apertures and prevents air from passing therethrough.

4. The device of claim 3, wherein:

said sealing means further comprising a continuous seal forming a seal over said upper and lower surface apertures;

said cover having a pull tab for removal thereof.

5. The device of claim 1, wherein:

said capsule sidewalls mate with said upper surface to form a lip;

said lip adapted to form an air tight seal over a bowl upper rim and only allow air to be drawn into said bowl through said apertures.

6. The device of claim 1, wherein said capsule sidewalls are adapted to mate against the interior of a hookah bowl and affect an air tight seal there against, only allowing air to be drawn into said bowl through said apertures.

7. The device of claim 1, wherein a capsule retainment system comprising an upper ring adapted to secure said capsule against a bowl upper rim.

8. The device of claim 7, wherein said upper ring is a hinged member that is secured using a lever clamping arm that removably attaches to said upper ring.

9. The device of claim 1, wherein said freely movable agitator further comprises an object of higher mass than said smokable material loosely positioned within said smokable material.

10. The device of claim 1, wherein said freely movable agitator further comprises a rigid cross member loosely positioned within said smokable material.

11. The device of claim 1, wherein said freely movable agitator further comprises a geometrically shaped object having protruding flanges loosely positioned within said smokable material.

12. The device of claim 11, wherein said freely movable agitator object comprises a three-dimensional star shape.

13. The device of claim 1, wherein said freely movable agitator further comprises a circularly coiled object having an open interior volume positioned within said smokable material.

* * * * *